US006253497B1

(12) United States Patent
Gekler et al.

(10) Patent No.: US 6,253,497 B1
(45) Date of Patent: Jul. 3, 2001

(54) SWINGABLE HANDRAIL APPARATUS

(76) Inventors: Roger L. Gekler; Paula S. Gekler, both of 416 Railroad Ave., Crestline, OH (US) 44827

( * ) Notice: Subject to any disclaimer, the term of this patent is extended or adjusted under 35 U.S.C. 154(b) by 0 days.

(21) Appl. No.: 09/506,554

(22) Filed: Feb. 18, 2000

(51) Int. Cl.[7] ..... E04F 19/00

(52) U.S. Cl. ..... 52/27; 4/604; 4/662; 256/67; 256/65; 248/251; 248/291.1

(58) Field of Search ..... 52/27, 64; 4/604, 4/662, 663, 665, 613, 615, 621, 555, 567, 548; 256/67, 65, 59; 248/291.1; 16/436, 438

(56) References Cited

U.S. PATENT DOCUMENTS

| | | | | |
|---|---|---|---|---|
| D. 378,432 | | 3/1997 | Raynes . | |
| 2,851,304 | * | 9/1958 | Timms | 248/251 |
| 4,266,318 | * | 5/1981 | Dauwalder | 16/11 |
| 4,882,791 | | 11/1989 | Kimes . | |
| 4,939,876 | | 7/1990 | Berner . | |
| 5,065,462 | | 11/1991 | Romano . | |
| 5,076,547 | | 12/1991 | Osterholm . | |
| 5,551,194 | | 9/1996 | Toomey . | |

* cited by examiner

*Primary Examiner*—Carl D. Friedman
*Assistant Examiner*—Chi Nguyen

(57) ABSTRACT

A swingable handrail apparatus for assisting a person onto and off a toilet, in particular. The swingable handrail apparatus includes a mounting bracket being adapted to mount to a wall structure and having a base member, a pair of boss members being spaced apart and each having a groove therein, a pair of clamping members each having a groove therein and being fastenable to a respective boss member; and also includes a handrail support member being rotatably mounted to the mounting bracket; and further includes a handrail member having a first end securely attached to the handrail support member and having a second end; and also includes a handrail support bracket having a base member, a first and second boss members being spaced apart and forming a handrail receiving space, a lever member pivotally attached to the base member and having a handrail retaining member which is biasedly received in a notch in the handrail member with the lever member being essentially spring-loaded.

11 Claims, 2 Drawing Sheets

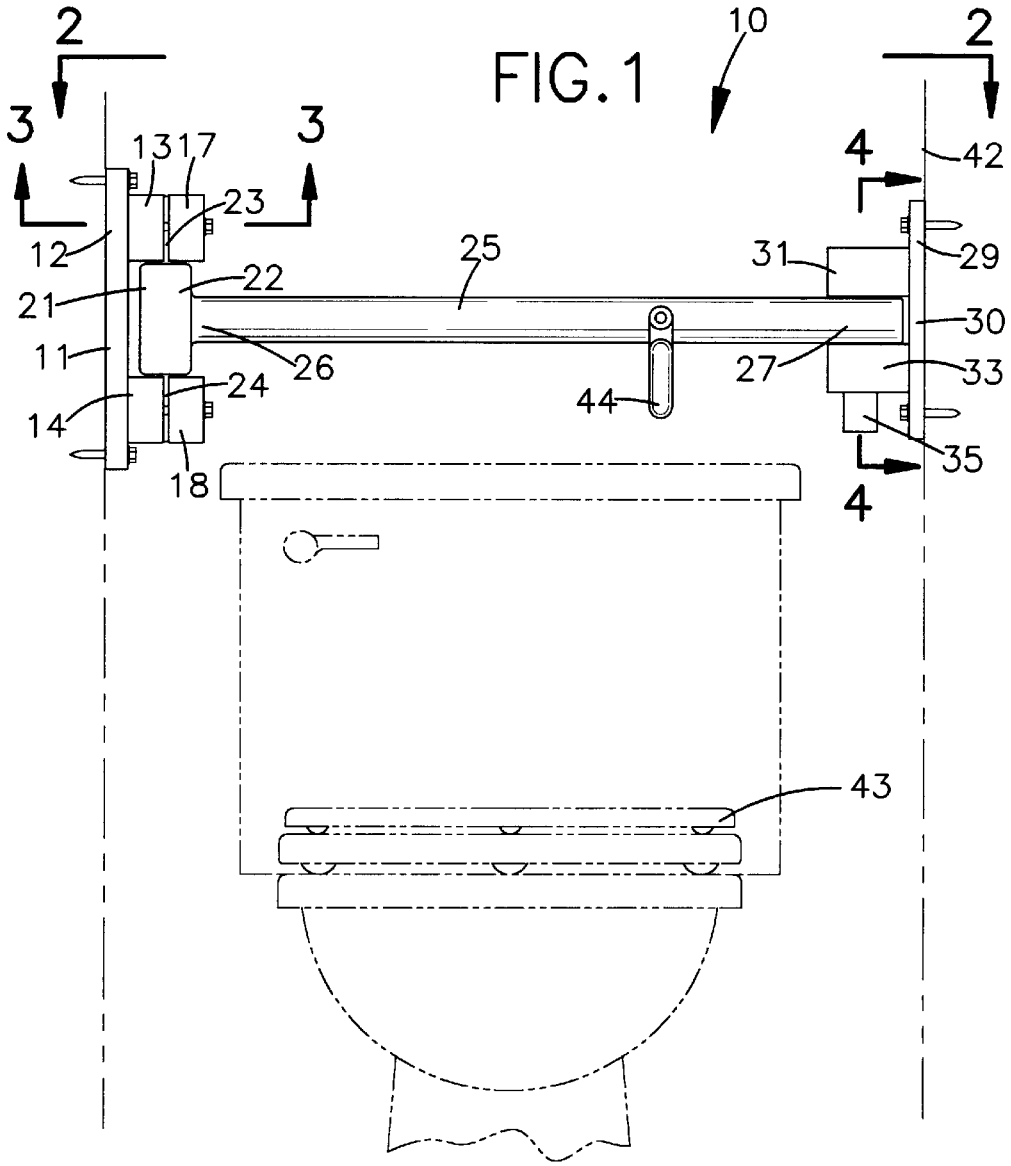
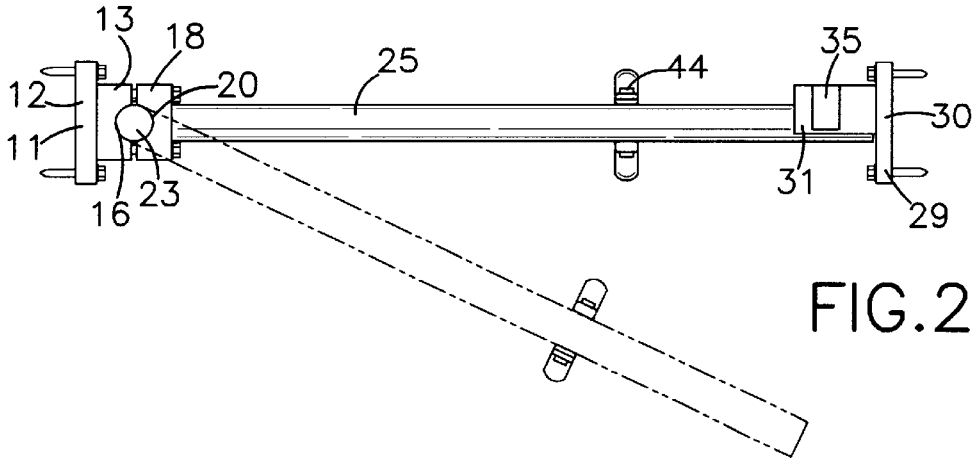
FIG. 2

SWINGABLE HANDRAIL APPARATUS

BACKGROUND OF THE INVENTION

1. Field of the Invention

The present invention relates to a handy and accessible bar and more particularly pertains to a new swingable handrail apparatus for assisting a person onto and off a toilet, in particular.

2. Description of the Prior Art

The use of a handy and accessible bar is known in the prior art. More specifically, handy and accessible bar heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,939,876; U.S. Pat. No. 5,551,194; U.S. Pat. No. 5,065,462; U.S. Pat. No. Des. 378,432; U.S. Pat. No. 4,882,791; and U.S. Pat. No. 5,076,547.

While these devices fulfill their respective, particular objectives and requirements, the aforementioned patents do not disclose a new swingable handrail apparatus. The inventive device includes a mounting bracket being adapted to mount to a wall structure and having a base member, a pair of boss members being spaced apart and each having a groove therein, a pair of clamping members each having a groove therein and being fastenable to a respective boss member; and also includes a handrail support member being rotatably mounted to the mounting bracket; and further includes a handrail member having a first end securely attached to the handrail support member and having a second end; and also includes a handrail support bracket having a base member, a first and second boss members being spaced apart and forming a handrail receiving space, a lever member pivotally attached to the base member and having a handrail retaining member which is biasedly received in a notch in the handrail member with the lever member being essentially spring-loaded.

In these respects, the swingable handrail apparatus according to the present invention substantially departs from the conventional concepts and designs of the prior art, and in so doing provides an apparatus primarily developed for the purpose of assisting a person onto and off a toilet, in particular.

SUMMARY OF THE INVENTION

In view of the foregoing disadvantages inherent in the known types of handy and accessible bar now present in the prior art, the present invention provides a new swingable handrail apparatus construction wherein the same can be utilized for assisting a person onto and off a toilet, in particular.

The general purpose of the present invention, which will be described subsequently in greater detail, is to provide a new swingable handrail apparatus which has many of the advantages of the handy and accessible bar mentioned heretofore and many novel features that result in a new swingable handrail apparatus which is not anticipated, rendered obvious, suggested, or even implied by any of the prior art handy and accessible bar, either alone or in any combination thereof.

To attain this, the present invention generally comprises a mounting bracket being adapted to mount to a wall structure and having a base member, a pair of boss members being spaced apart and each having a groove therein, a pair of clamping members each having a groove therein and being fastenable to a respective boss member; and also includes a handrail support member being rotatably mounted to the mounting bracket; and further includes a handrail member having a first end securely attached to the handrail support member and having a second end; and also includes a handrail support bracket having a base member, a first and second boss members being spaced apart and forming a handrail receiving space, a lever member pivotally attached to the base member and having a handrail retaining member which is biasedly received in a notch in the handrail member with the lever member being essentially spring-loaded.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new swingable handrail apparatus which has many of the advantages of the handy and accessible bar mentioned heretofore and many novel features that result in a new swingable handrail apparatus which is not anticipated, rendered obvious, suggested, or even implied by any of the prior art handy and accessible bar, either alone or in any combination thereof.

It is another object of the present invention to provide a new swingable handrail apparatus which may be easily and efficiently manufactured and marketed.

It is a further object of the present invention to provide a new swingable handrail apparatus which is of a durable and reliable construction.

An even further object of the present invention is to provide a new swingable handrail apparatus which is susceptible of a low cost of manufacture with regard to both materials and labor, and which accordingly is then susceptible of low prices of sale to the consuming public, thereby making such swingable handrail apparatus economically available to the buying public.

Still yet another object of the present invention is to provide a new swingable handrail apparatus which provides in the apparatuses and methods of the prior art some of the advantages thereof, while simultaneously overcoming some of the disadvantages normally associated therewith.

Still another object of the present invention is to provide a new swingable handrail apparatus for assisting a person onto and off a toilet, in particular.

Yet another object of the present invention is to provide a new swingable handrail apparatus which includes a mounting bracket being adapted to mount to a wall structure and having a base member, a pair of boss members being spaced apart and each having a groove therein, a pair of clamping members each having a groove therein and being fastenable to a respective boss member; and also includes a handrail support member being rotatably mounted to the mounting bracket; and further includes a handrail member having a first end securely attached to the handrail support member and having a second end; and also includes a handrail support bracket having a base member, a first and second boss members being spaced apart and forming a handrail receiving space, a lever member pivotally attached to the base member and having a handrail retaining member which is biasedly received in a notch in the handrail member with the lever member being essentially spring-loaded.

Still yet another object of the present invention is to provide a new swingable handrail apparatus that essentially reduces the risk of injury by the user falling onto the toilet.

Even still another object of the present invention is to provide a new swingable handrail apparatus that allows the user to properly seat oneself on the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a new swingable handrail apparatus according to the present invention and being disposed above a toilet.

FIG. 2 is a top plan view of the present invention.

DESCRIPTION OF THE PREFERRED EMBODIMENT

Figure 3:
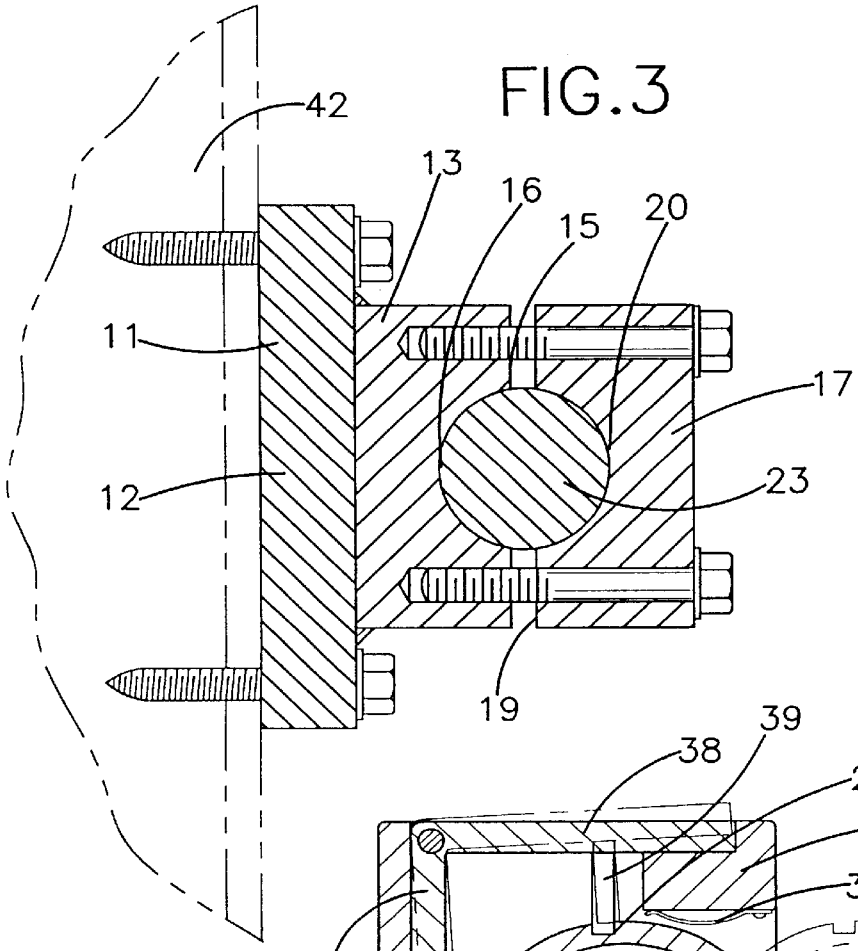
FIG. 3 is a cross sectional view of the mounting bracket of the present invention.
Figure 4:
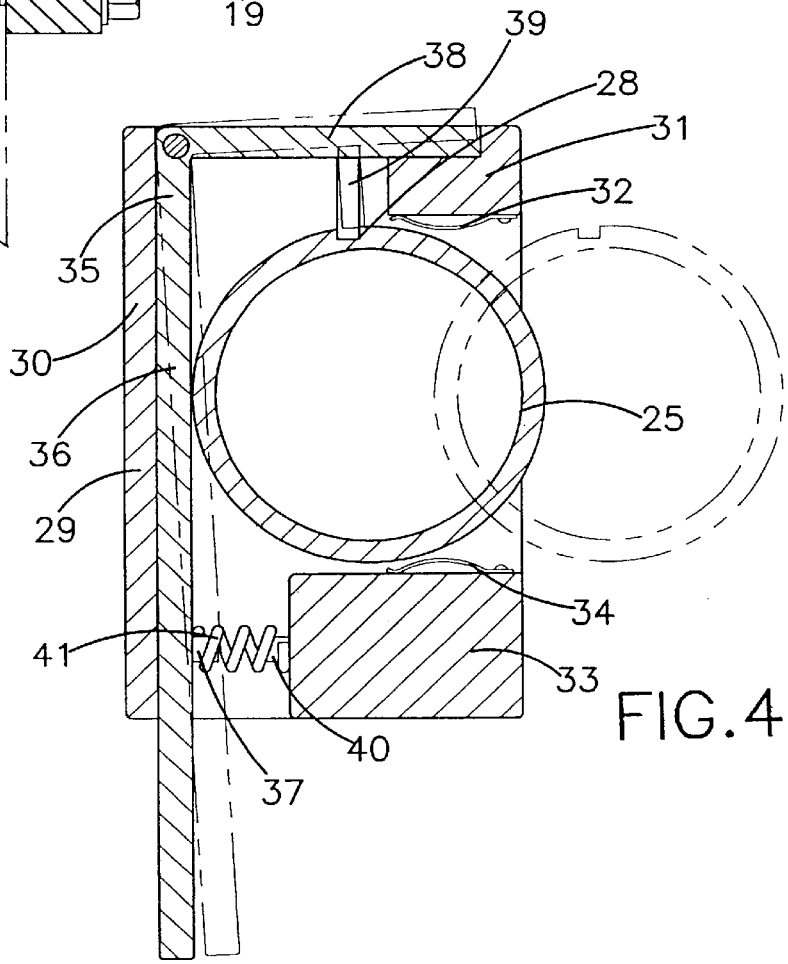
FIG. 4 is a cross sectional view of the handrail support bracket of the present invention.

With reference now to the drawings, and in particular to FIGS. 1 through 4 thereof, a new swingable handrail apparatus embodying the principles and concepts of the present invention and generally designated by the reference numeral 10 will be described.

As best illustrated in FIGS. 1 through 4, the swingable handrail apparatus 10 generally comprises a mounting bracket 11 being adapted to securely mount to a wall structure 42. A handrail support member 21 is rotatably mounted to the mounting bracket. The mounting bracket 11 includes a base member 12 being adapted to securely mount with fasteners to a wall structure 42, a pair of boss members 13,14 being spaced apart and being securely and conventionally attached to the base member 12, and a pair of clamping members 17,18 each of which is fastenable to a respective one of the boss members 13,14 for securely retaining a portion of the handrail support member 21. Each of the boss members 13,14 includes an outer side 15 facing away from the base member 12 and also includes a groove 16 extending in the outer side 15 and extending from one end to another end thereof. Each of the clamping members 17,18 includes a side 19 having a groove 20 extending therein. The end portions of the handrail support member 21 are securely received in the grooves 16,20 of the boss members 13,14 and the clamping member 17,18. The handrail support member 21 includes a cylindrical member 22 and a pair of shafts 23,24 extending from either end of the cylindrical member 22. The shafts 23,24 are received in the grooves 16,20 of the boss members 13,14 and the clamping members 17,18.

A handrail member 25 has a first end 26 which is securely and conventionally attached and welded to the handrail support member 21 and has a second end 27. The handrail member 25 includes a notch 28 in a side and near the second end 27 thereof with the handrail member 25 having a length of approximately 48 to 52 inches and a diameter of approximately 1 inch.

A handrail support bracket 29 is adapted to be securely mounted with fasteners to a wall structure 42 and has a base member 30, a first boss member 31 securely and conventionally attached to the base member 30, and a second boss member 33 securely and conventionally attached to the base member 30 and being spaced from the first boss member 31 and defining a handrail-receiving space between the first boss member 31 and the second boss member 33. The handrail support bracket 29 further includes a lever member 35 having a first portion 36 and a second portion 38 which is angled from the first portion 36. The lever member 35 is pivotally attached at an intermediate portion to the base member 30 of the handrail support bracket 29 with the first portion 36 extending downwardly below the second boss member 33. The lever member 35 further has a handrail retaining member 39 extending from the second portion 38 and being engageable in the notch 28 for retaining the handrail member 25 in the handrail support bracket 29. The lever member 35 also has a lug member 37 extending from the first portion. The handrail support bracket 29 also includes a first leaf spring 32 being securely attached with fasteners to a side of the first boss member 31 and being disposed in the handrail retaining space and includes a second leaf spring 34 being securely attached with fasteners to a side of the second boss member 33 and being disposed in the handrail retaining space, both of the leaf springs 32,34 aiding in the retention of the handrail member 25 in the handrail support bracket 29. The second boss member 33 includes a back side and a lug member 40 securely and conventionally disposed on the back side thereof. The handrail support bracket 29 further includes a spring member 41 securely attached about the lug member 37 of the lever member 35 and the lug member 40 of the second boss member 33 for biasing the handrail retaining member 39 in the notch 28 of the handrail member 25. A handhold member 44 is securely attached with a fastener to the handrail member 25.

In use, the swingable handrail apparatus 10 is best suited adjacent to a toilet 43 so that a physically disabled person can aid oneself to and from the toilet 43. The user would urge the lower portion 36 of the lever member 35 forwardly or toward the second boss member 33 which would release and urge the handrail member 25 out from the handrail support bracket 29. The user would then grasp and hold onto the handrail member 25 as he/she lifts oneself onto or from a toilet 43.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A swingable handrail apparatus comprising:

a mounting bracket adapted to be securely mounted to a wall structure;

a handrail support member rotatably mounted to said mounting bracket;

a handrail member having a first end which is securely attached to said handrail support member and having a second end;

a handrail support bracket adapted to be securely mounted to a wall structure and having a base member, a first boss member securely attached to said base member, and a second boss member securely attached to said base member and being spaced from said first boss member and defining a handrail-receiving space between said first boss member and said second boss member; and a handhold member securely attached to said handrail member.

2. A swingable handrail apparatus as described in claim 1, wherein said mounting bracket includes a base member being adapted to securely mount to a wall structure, a pair of boss members being spaced apart and being securely attached to said base member, and a pair of clamping members each of which is fastenable to a respective one of said boss members for securely retaining a portion of said handrail support member.

3. A swingable handrail apparatus as described in claim 2, wherein each of said boss members includes an outer side facing away from said base member and also includes a groove extending in said outer side and extending from one end to another end thereof.

4. A swingable handrail apparatus as described in claim 3, wherein each of said clamping members includes a side having a groove extending therein, said end portions of said handrail support member being securely received in said grooves of said boss members and said clamping member.

5. A swingable handrail apparatus as described in claim 4, wherein said handrail support member includes a cylindrical member and a pair of shafts extending from either end of said cylindrical member, said shafts being received in said grooves of said boss members and said clamping members.

6. A swingable handrail apparatus as described in claim 5, wherein said handrail member includes a notch in a side and near said second end thereof.

7. A swingable handrail apparatus as described in claim 6, wherein said handrail support bracket further includes a lever member having a first portion and a second portion which is angled from said first portion, said lever member also being pivotally attached at an intermediate portion to said base member of said handrail support bracket, said lever member further having a handrail retaining member extending from said second portion and being engageable in said notch for retaining said handrail member in said handrail support bracket., said lever member also having a lug member extending from said first portion.

8. A swingable handrail apparatus as described in claim 7, wherein said handrail support bracket also includes a first leaf spring being securely attached to a side of said first boss member and being disposed in said handrail retaining space and includes a second leaf spring being securely attached to a side of said second boss member and being disposed in said handrail retaining space, both of said leaf springs aiding in the retention of said handrail member to said handrail support bracket.

9. A swingable handrail apparatus as described in claim 8, wherein said second boss member includes a back side and a lug member securely disposed on said back side thereof.

10. A swingable handrail apparatus as described in claim 9, wherein said handrail support bracket further includes a spring member securely attached about said lug member of said lever member and said lug member of said second boss member for biasing said handrail retaining member in said notch of said handrail member.

11. A swingable handrail apparatus comprising:

a mounting bracket adapted to be securely mounted to a wall structure;

a handrail support member rotatably mounted to said mounting bracket, said handrail support member including a cylindrical member and a pair of shafts extending from either end of said cylindrical member, said mounting bracket including a base member being adapted to securely mount to a wall structure, a pair of boss members being spaced apart and being securely attached to said base member, and a pair of clamping members each of which is fastenable to a respective one of said boss members for securely retaining a portion of said handrail support member, each of said boss members including an outer side facing away from said base member and also including a groove extending in said outer side and extending from one end to another end thereof, each of said clamping members including a side having a groove extending therein, said end portions of said handrail support member being securely received in said grooves of said boss members and said clamping member, said shafts being received in said grooves of said boss members and said clamping members;

a handrail member having a first end which is securely attached to said handrail support member and having a second end, said handrail member including a notch in a side and near said second end thereof, said handrail member having a length of approximately 48 to 52 inches and a diameter of approximately 1 inch;

a handrail support bracket adapted to be securely mounted to a wall structure and having a base member, a first boss member securely attached to said base member, and a second boss member securely attached to said base member and being spaced from said first boss member and defining a handrail-receiving space between said first boss member and said second boss member, said handrail support bracket further including a lever member having a first portion and a second portion which is angled from said first portion, said lever member also being pivotally attached at an intermediate portion to said base member of said handrail support bracket, said lever member further having a handrail retaining member extending from said second portion and being engageable in said notch for retaining said handrail member in said handrail support bracket, said lever member also having a lug member extending from said first portion, said handrail support bracket also including a first leaf spring being securely attached to a side of said first boss member and being disposed in said handrail retaining space and including a second leaf spring being securely attached to a side of said second boss member and being disposed in said handrail retaining space, both of said leaf springs aiding the retention of said handrail member to said handrail support bracket, said second boss member including a back side and a lug member securely disposed on said back side thereof, said handrail support bracket further including a spring member securely attached about said lug member of said lever member and said lug member of said second boss member for biasing said handrail retaining member in said notch of said handrail member; and a handhold member securely attached to said handrail member.

* * * * *